United States Patent [19]

Overman et al.

[11] Patent Number: 4,559,419

[45] Date of Patent: Dec. 17, 1985

[54] CODING SWITCH ASSEMBLY

[75] Inventors: David L. Overman; William L. Konick, both of Silver Spring, Md.

[73] Assignee: The United States of America as represented by the Secretary of the Army, Washington, D.C.

[21] Appl. No.: 641,109

[22] Filed: Aug. 15, 1984

[51] Int. Cl.[4] ..... H01H 9/00

[52] U.S. Cl. ..... 200/5 R; 200/6 B; 200/308

[58] Field of Search ..... 200/5 R, 14, 17 R, 159 B, 200/18, 5 A, 308, 292, 38 C, 153 LB, 153 N, 11 DA, 27 B, 6 B, 6 BA

[56] References Cited

U.S. PATENT DOCUMENTS

| | | | |
|---|---|---|---|
| 852,468 | 5/1907 | Stull | 200/18 |
| 3,324,267 | 6/1967 | Edelson | 200/153 LB |
| 3,761,944 | 9/1973 | Shimojo | 200/159 B X |
| 3,903,383 | 9/1975 | Marker | 200/308 X |

OTHER PUBLICATIONS

Davis, "Wafer Switch", IBM Tech. Disclosure Bulletin, vol. 18, No. 10, 3/76, pp. 3405–3406.

*Primary Examiner*—J. R. Scott
*Assistant Examiner*—Morris Ginsburg
*Attorney, Agent, or Firm*—Saul Elbaum; Thomas E. McDonald; Anthony T. Lane

[57] ABSTRACT

Apparatus for setting and displaying a numerical value to be encoded to an electronic device, including a molded plastic support structure, a printed circuit board membrane type switch assembly which is affixed to the support structure and which includes a plurality of rows of four switches, and a like plurality of molded plastic switch actuator shafts associated respectively with the rows of four switches. Each actuator shaft has a longitudinal axis extending parallel to the associated row of four switches, and is pivotally connected to the support structure for rotation about its axis. Each shaft includes a plurality of raised annular segments for opening and closing the four switches in the adjacent row. The segments are arranged so as to provide ten combinations of open and closed switches as the shaft is rotated, to provide a 4-bit binary code corresponding to one of ten numbers 0–9, depending on the rotary shaft position. Also, each shaft includes the ten numbers 0–9 disposed about the shaft axis on the front surface of a shaft flange such that the number adjacent an indicator on the support structure corresponds to the binary code setting. The numbers 0–9 carried by each actuator shaft are oriented such that the indicated numbers are readable as a discrete number in standard decimal format corresponding to the numerical value to be encoded.

20 Claims, 12 Drawing Figures

CODING SWITCH ASSEMBLY

RIGHTS OF THE GOVERNMENT

The invention described herein may be manufactured, used, and licensed by or for the United States Government for governmental purposes without payment to us of any royalty thereon.

BACKGROUND OF THE INVENTION

The invention relates generally to numerical encoding devices for electronic circuits. More particularly, the invention relates to a coding switch, utilizing a printed circuit board switch assembly for setting and displaying a time value to be encoded to an electronic artillery fuze.

Several types of fuzes used on artillery amunitions require the setting of an event time prior to firing. The fuze setting time system must be a rugged, compact system, in which the time value can be accurately set and displayed, without the use of electric power. In the past, this has often been done by turning the fuze nose relative to markings on the fuze body, for example, to adjust a timing cam of a mechanical timer or a timing resistor of an electrical timer. In such a system, the number of possible time settings is limited by the requirement that the selected time setting be legibly displayed on an exterior surface of the fuze.

OBJECTS AND SUMMARY OF THE INVENTION

It is an object of the invention to provide a simple, low cost, coding switch assembly for manually setting and displaying a numerical value to be encoded to an electronic device.

It is a further object of the invention to provide such a coding switch assembly, in which the selected numerical value is displayed as a discrete readable number, in standard decimal format.

It is another object of the invention to provide a coding switch assembly for manually setting and displaying a time value to be encoded to an electronic artillery fuze.

The coding switch assembly, according to the invention, includes the printed circuit board membrane type switch assembly affixed to a support structure. The switch assembly includes a plurality of pressure actuated switches arranged in straight rows of at least four switches, with both sides of each switch being connected to terminals carried on the circuit board. Generally, one side of each switch will be connected to an individual terminal while the other side of each switch will be connected to an common ground terminal.

The coding switch assembly also includes a plurality of switch actuator shafts, corresponding in number to the number of rows of the switch assembly, which are rotatably supported by the support structure so that each actuator shaft can be individually rotated by manual means about its longitudinal axis. Each actuator shaft is disposed so that its axis of rotation extends above and parallel to a corresponding row of switches of the switch assembly. Each actuator shaft includes a plurality of raised portions or protrusions corresponding to the switches in the adjacent row. Each shaft protrusion is disposed adjacent one of these switches, such that the shaft protrusion opens and closes the switch as the shaft is rotated about its axis. The protrusions of each actuator shaft are formed so as to provide ten different combinations of opened and closed switches in the adjacent row at corresponding positions of the actuator shaft as the shaft is rotated about its axis. The ten combinations of open and closed switches in each row constitute multibit codes corresponding to the numbers 0–9, respectively, which are encoded to the electronic device. Thus, when binary coding is utilized, each row of switches will include four switches which are actuated open or closed by the adjacent actuator shaft to generate binary codes corresponding to the numbers 0–9.

One end of each actuator shaft is slotted and extends through a front portion of the support structure so that each shaft can be individually rotated to a desired position by an operator using a conventional screwdriver. Each actuator shaft includes a flange which carries the numbers 0–9 on its front surface corresponding to the ten positions of the actuator shaft. The flange of each actuator shaft is positioned adjacent the front portion of the support structure, which includes an opening therethrough so that one of these numbers on the flange can be viewed by the operator to properly set the row of switches to provide a multibit code corresponding to that number. Since all the actuator switches are disposed in the common plane, the displayed numbers of these actuator shafts, as seen by the operator, constitute the numerical value to be encoded to the electronic device. To accomplish this, the numbers in each row of switches is appropriately weighted and added together in the electronic device. For example, if the least significant number of the numerical value, that is, the number on the right, corresponds to a time setting in tenths of a second, the adjacent row of numbers to the left of the least significant number will correspond to time settings in seconds, and the next adjacent row of numbers will correspond to time settings in tens of seconds.

In another embodiment of the invention, the numbers 0–9 for each actuator shaft are disposed on the front surface of the support structure around the actuator shaft, which carries an arrow or other indication mark on its end surface which is aligned with one of the numbers 0–9 to indicate the number to be encoded to the electronic device.

Also, to reduce the cost of this coding switch assembly, the support structure and the individual actuator shafts can be molded plastic elements. Such a low cost coding switch is particularly useful in applications where this coding switch is expendable, for example, as the coding switch of an electronic artillery fuze for setting and displaying a time value to be encoded to the fuze upon firing of the artillery projectile.

BRIEF DESCRIPTION OF THE DRAWINGS

The invention will be better understood, and further objects, features, and advantages thereof will become more apparent from the following description of preferred embodiments, taken in conjunction with the accompanying drawings in which.

DESCRIPTION OF PREFERRED EMBODIMENTS

Figure 1:
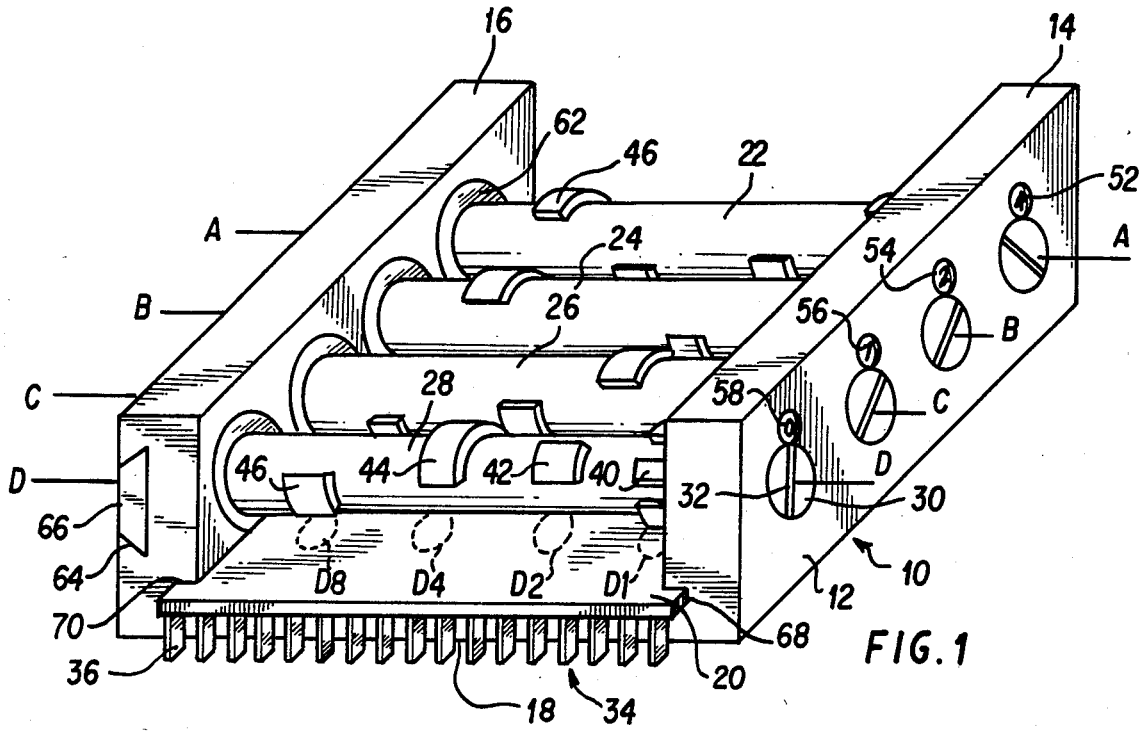
FIG. 1 is a perspective view of a first embodiment of the invention.

The coding switch assembly 10 shown in FIG. 1 includes a generally U-shaped molded plastic support structure 12 having a front portion 14, a rear portion 16, and a recessed center portion 18. A 4×4 double-sided, printed circuit board membrane type switch assembly 20 is disposed on the center portion 18 of the support structure 12. Four identical, molded plastic actuator shafts 22, 24, 26, 28 are pivotally connected to the front and rear sections 14, 16 of the support structure 12 for rotation about their respective longitudinal axes A-A, B-B, C-C, and D-D, which extend in a plane parallel to that of the switch assembly 20. The front end 30 of each actuator shaft extends through the support structure front portion 14 and includes a slot 32 therein, into which a screwdriver may be inserted by an operator to manually rotate each actuator shaft about its axis.

Figure 2:
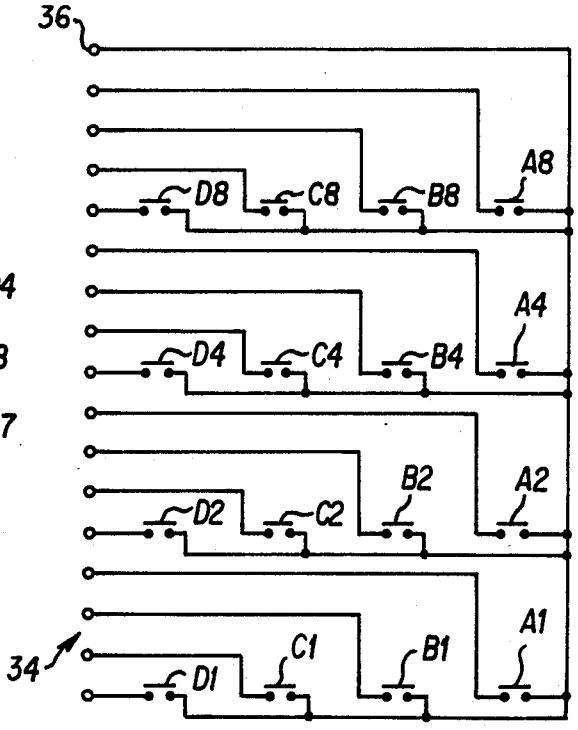
FIG. 2 is an electrical schematic of the embodiment of FIG. 1.

The switch assembly 20 includes sixteen pressure-actuated, membrane type switches arranged in rows of 4 switches directly below the actuator shaft axes A-A, B-B, C-C, and D-D, respectively. Each row of switches constitutes a four-bit binary code which is supplied to an electronic device. For convenience, the switches have been identified by the adjacent actuator shaft axis and the weight given each switch. For example, the four switches in the row of switches directly beneath the actuator shaft 28 are identified as switches D1, D2, D4, and D8. A group of terminals 34, which are disposed on the left side of the switch assembly 20, as shown in FIG. 1, are connected to the 16 membrane type switches to facilitate the connection of the switches to the electronic device. As shown in FIG. 2, one side of each of these switches is brought out to an individual terminal, while the other side of the switches are connected to a common ground terminal 36.

Figure 3:
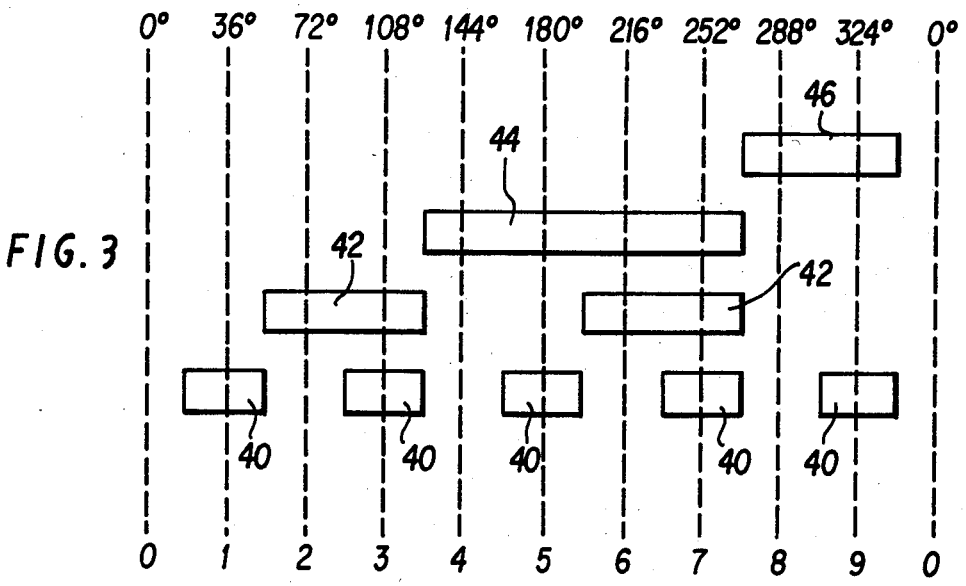
FIG. 3 is a development diagram for an actuator shaft of the embodiment of FIG. 1, showing the number and distribution of raised annular segments.

Each actuator shaft includes a plurality of raised annular portions or segments 40, 42, 44, and 46 which are respectively disposed along the length of the shaft adjacent the membrane switches of the switch assembly 20, so that each segment will open and close an adjacent switch of the switch assembly 20 as the actuator shaft is rotated. The number and distribution of these annular segments is shown in FIG. 3. Thus, each actuator shaft includes five annular segments 40 disposed uniformly about the shaft axially adjacent the switch A1, B1, C1, or D1 of the adjacent row having the least weighted value. Similarly, each actuator shaft includes two annular raised segments 42 axially adjacent the switch A2, B2, C2 or D2 in the adjacent row of switches having a weighted value of 2. Each actuator shaft includes a raised segment 46 axially adjacent the switch A4, B4, C4, or D4 in the adjacent row of switches having a weighted value of 4. Finally, each actuator switch includes an annular raised segment 46 axially adjacent the switch A8, B8, C8, or D8 in the adjacent row of switches of the switch assembly 20 having a weighted value of 8. As seen in FIG. 3, each actuator shaft may be rotated to provide 10 binary codes from 0 to 9 to be provided to the electronic device.

Figure 12:
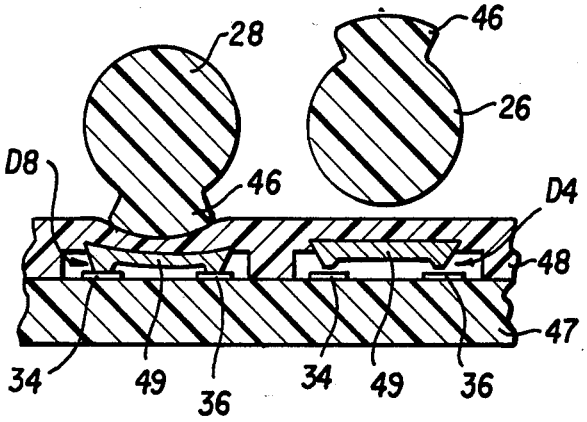
FIG. 12 is a partial cross-sectional view of the embodiment of FIG. 1, taking along a line passing through the raised segments 46 of the actuator shafts.

Any conventional printed circuit board membrane type switch assembly may be used for the switch assembly 20. For example, the switch assembly 20 shown in FIG. 12 is similar to that described in U.S. Pat. No. 3,761,944, issued Sept. 12, 1973 to Shimojo. It includes a substrate 47 of rigid insulating material and a cover member 48 formed of a single integral sheet of resilient insulating material. Each of the 16 membrane switches, such as the switches D4 and D8 shown in FIG. 12, includes a resilient electrically conductive contact member 49 affixed to the cover member 48 and extending above the common ground terminal 36 and an adjacent one of the terminals 34. As shown in FIG. 12, when the actuator shaft 28 is rotated so that its raised segment 46 is brought into contact with the cover member 48, the contact member 49 directly beneath the actuator shaft 28 is moved downward to establish contact between the ground terminal 36 and the adjacent terminal 34.

Figure 9:
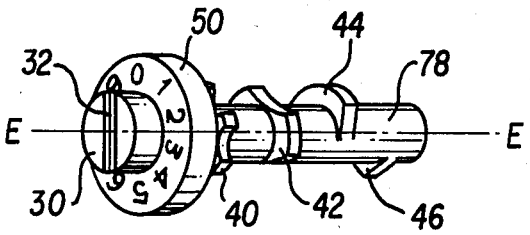
FIG. 9 is a perspective view of one of the actuator shafts of the embodiment of FIGS. 6 and 7.
Figure 7:
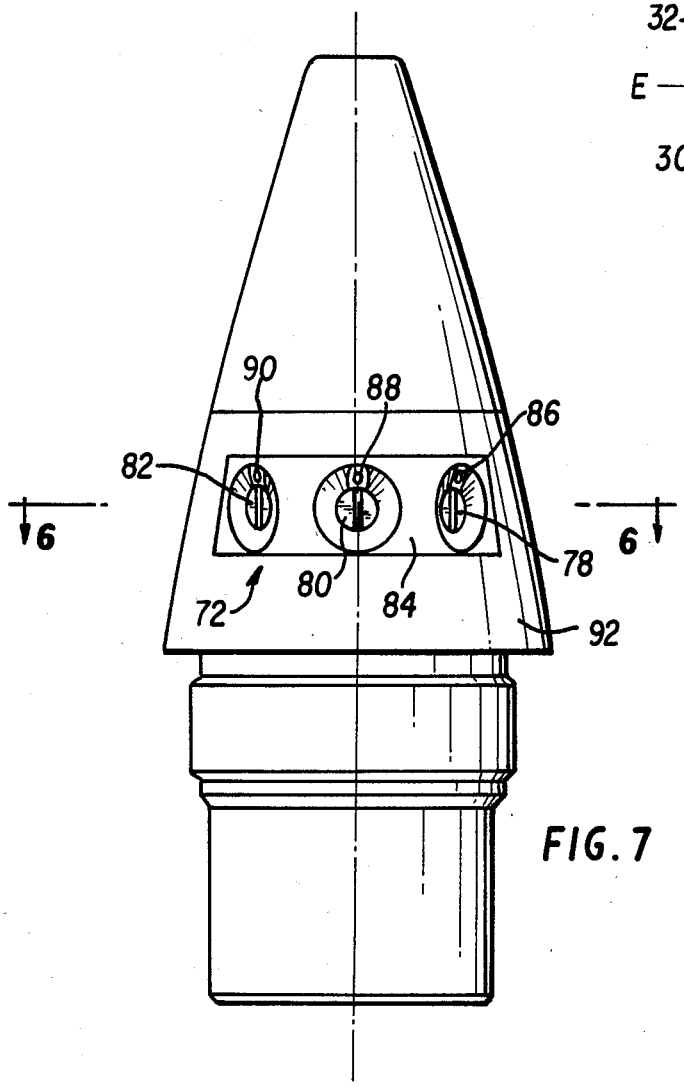

Each actuator shaft 22–28 also includes a flange 50 similar to that shown in FIG. 9, bearing the series of ten numbers 0–9 spaced uniformly about its front surface. The front portion 14 of the support structure 12 includes four openings 52, 54, 56, and 58 disposed respectively above the actuator shafts 22, 24, 26 and 28, so that the topmost member on the flange 50 of each actuator shaft may be viewed therethrough. These numbers are arranged on the flange 50 of each actuator shaft so that the number seen through the opening 52, 54, 56, or 58 associated with that shaft indicates the number, in binary code, to be encoded to the electronic device. In the electronic device, the number encoded by the second shaft 24 is multiplied by 10, the number encoded by the third shaft 26 is multiplied by 100, and a number multiplied by the fourth shaft 28 is multiplied by 1000, and all of these multiplied numbers are added to the number encoded by the first actuator shaft 22. Thus, the numerical value to be encoded to the electronic device is displayed within the openings 52–58 as a discrete, readable number, in standard decimal format. The 4-shaft coding switch assembly 10 will produce and display 10,000 discrete settings, from 0 to 9999, using basically only six component parts.

Figure 4:
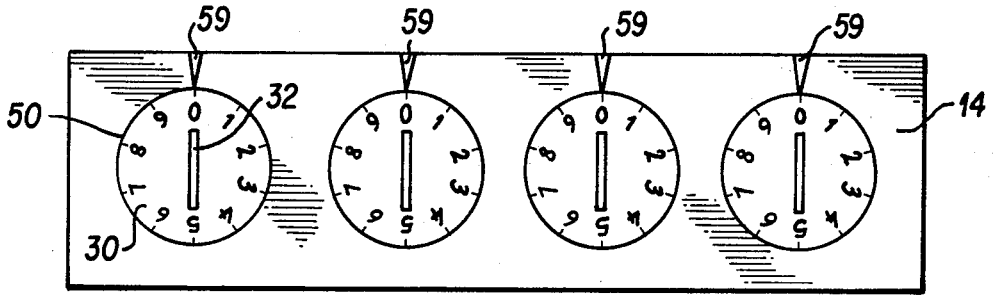
FIGS. 4 and 5 are front views, of two other embodiments of the invention.
Figure 5:
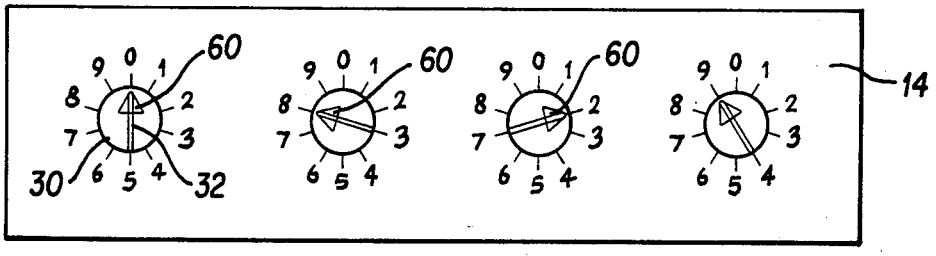

There are other methods of displaying the numerical value to be encoded to the electronic device. For example, the front end 30 of each actuator shaft can also constitute the front surface of the flange 50 carrying the numbers 0–9, as shown in FIG. 4, in which case, the support structure front portion 14 includes four indicator marks 59 adjacent the four actuator shafts, respectively, for indicating the actuator shaft settings. Also, the series of numbers 0–9 can be disposed on the support structure front portion 14 about each actuator shaft 22, 24, 26 and 28, as shown in FIG. 5, in which case, each actuator shaft end 30 includes an arrow 60 or other indication mark to position the actuator shaft at the desired setting. However, the display system shown in the device of FIG. 1 is preferred, since only the numerical value to be encoded is seen by the observer as a properly orientated, readable number.

The matrix switch assembly, the actuator shafts, and the support structure can be assembled in various ways. For example, each actuator shaft may have a rear flange or collar 62 of maximum diameter, which rotates within openings in the rear portion 16 of the support structure 12. The actuator shafts are inserted through these openings in the support structure rear portion 16. Also, the rear portion 16 may include a groove 64 into which a wedge 66 is inserted to limit the end play of the actuator shafts 22, 24, 26 and 28. The inner surfaces of the front and rear portions 14, 16 of the support structure may include grooves 68, 70, to guide and position the printed circuit board matrix switch assembly 20. Another simple way of assembling this device would be to form the support structure 12 as two elements, which are affixed to each other during assembly by epoxy, screws, or the like.

In the embodiments shown in FIGS. 6–9, a 3-shaft coding switch assembly 72 having a 3×4 printed circuit board membrane type switch assembly 74 is used to set and display a time value to be encoded to an electronic fuze for an artillery projectile upon firing of the projectile. The coding switch assembly 72 includes a molded plastic support structure 76, and three identical molded plastic actuator shafts 78, 80 and 82 which are pivotally carried by the support structure 76 for rotation about their longitudinal axes E-E, F-F, and G-G, respectively, which are disposed in a plane parallel to the plane of the printed circuit board switch assembly 74. The actuator shafts 78, 80, 82 are functionally identical with the actuator shafts 22–28 of the coding switch assembly 10 shown in FIG. 1, and include the same number and disposition of annular raised segments 40, 42, 44, and 46 as the actuator shafts of FIG. 1. Also, each actuator shaft 78, 80, 82 includes a front flange 50 having 10 members 0–9 inscribed or printed about its front surface, and a slotted end 30 which projects through an opening in a front portion 84 of the support structure 76, in the same manner as described above for the actuator shafts 22–28 of FIG. 1. The support structure front portion 84 includes three openings 86, 88, 90 above the actuator shafts 78, 80, 82, respectively, through which the number on each front flange 50 adjacent these openings can be viewed, in the same manner as described above for the coding switch assembly 10. The coding switch assembly 72 is mounted in the housing 92 of an artillery electronic fuze, with the outer surface of the support structure front portion 84 being formed to be essentially flush with the outer surface of the fuze housing 92.

Figure 6:
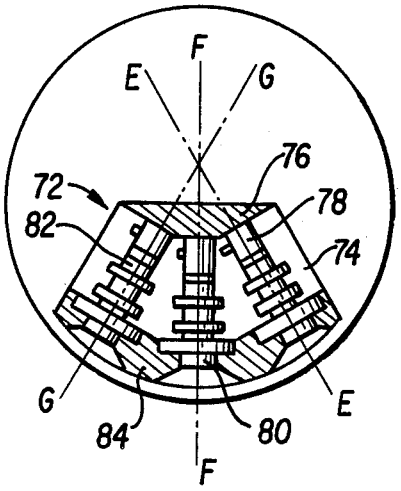
FIGS. 6 and 7 are plan and front views of a fourth embodiment of the invention, mounted in the housing of an electronic artillery fuze.
Figure 8:
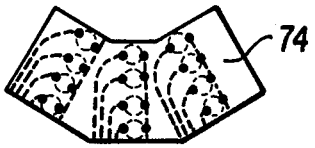
FIG. 8 is a plan view of the printed circuit board membrane type switch assembly for the embodiment of FIGS. 6 and 7.

The chief difference between the coding switch assembly 72 and the coding switch assembly 10 described above is that the axes of rotation E-E, F-F, G-G of the actuator shafts 78, 80 and 82, respectively, are disposed at an angle to each other to better conform the exposed front surface of the coding switch assembly 72 to the outer surface of the fuze housing 92, whereas, in the embodiment of FIG. 1, the axes of rotation of the four actuator shafts are disposed parallel to one another. Because of this arrangement, the support structure 76 and the printed circuit board switch assembly 74 are shaped so as to extend partially about the axes O-O of the fuze housing 92, as shown in FIGS. 6 and 8.

The printed circuit board switch assembly 74 includes three rows of pressure-actuated membrane type switches disposed directly beneath the three actuator shafts 78, 80, 82, respectively. Each actuator shaft 78, 80, 82 can be set by an operator using a screwdriver to provide a 4-bit binary code to the electronic fuze corresponding to the displayed number on the front flange 50. During operation of the fuze, the three encoded 4-bit binary codes are processed by conventional circuitry to provide time delay corresponding to the displayed time setting, that is, a time delay which is equal, in time units (seconds, tenths of seconds, or the like) to the number visible through the opening 86 plus the number visible through the opening 88 times 10 plus the number visible through the opening 90 times 100. For example, if the displayed numerical setting of the coding switch assemblies 72 indicates the encoded time value in tenths of a second, the three 4-bit binary codes can be loaded into three cascaded counters in a timing circuit of the fuze, which are arranged so that the first counter counts in 0.1 second intervals, the second counter counts in one second intervals, and the third counter counts in ten second intervals. The 4-bit code generated by the actuator shaft 78 is loaded into the first counter; the 4-bit code generated by the actuator shaft 80 is loaded into the second counter, and the 4-bit code generated by the actuator shaft 82 is loaded into the third counter.

Figure 10:
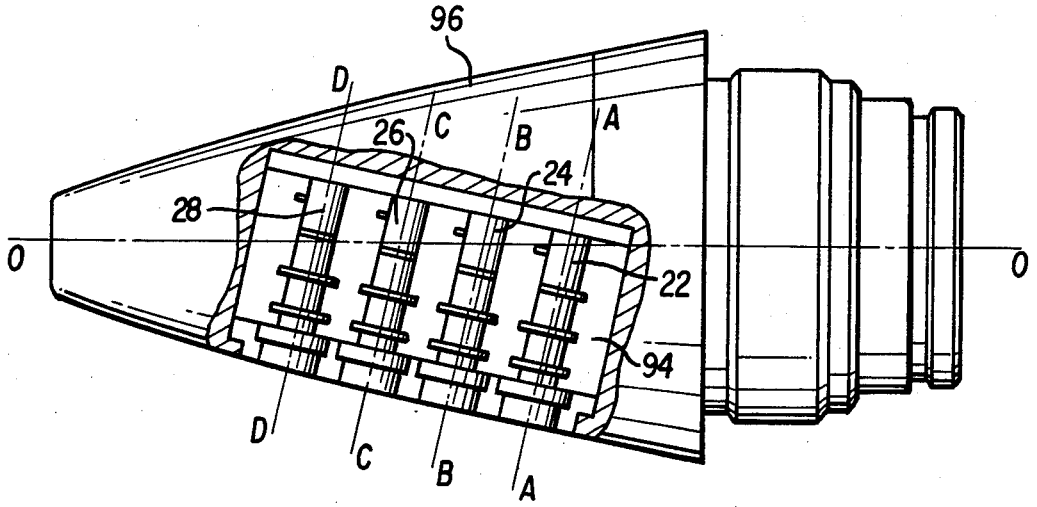
FIGS. 10 and 11 are plan and front views of the embodiment of FIG. 4, mounted in the housing of an electronic artillery fuze.
Figure 11:
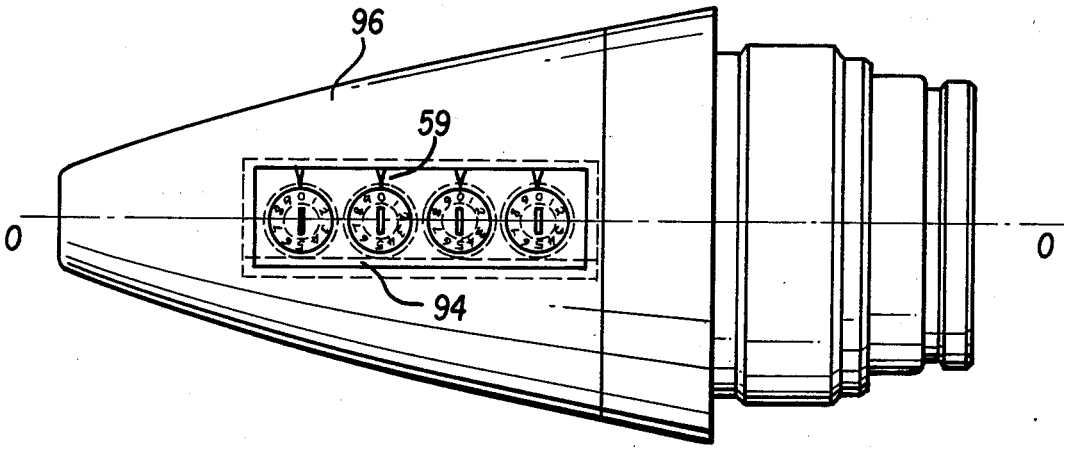

FIGS. 10 and 11 show a 4-shaft coding switch assembly 94, similiar to the embodiment of FIG. 4, which is mounted in the housing 96 of an electronic artillery fuze such that the parallel axes A-A, B-B, C-C, D-D of the actuator shafts 22, 24, 26, 28 intersect the fuze housing axis O-O. The coding switch assembly 94 is used to set and display one of 10,000 discrete time settings to be encoded to the electronic fuze, in the same manner as described above for the embodiment of FIGS. 6–9.

There are many variations and modifications of the invention which would be obvious to one skilled in the art. For example, electronic circuits could be mounted on the matrix switch printed circuit board. Various means of coding the actuator shaft rotary positions, such as decimal, binary, complementary, etc. could be used, and parity codes could be used to detect and correct coding errors. The switch assembly could be formed as a flexible tape assembly, rather than as a rigid circuit board assembly. The front ends of the actuator shafts could be formed to receive and engage an Allen wrench or a Phillips screwdriver. Since there are many variations, modifications, and additions to the specific embodiments of the invention described herein which would be obvious to one skilled in the art, it is intended that the scope of the invention be limited only by the appended claims.

What is claimed and desired to be secured by Letters Patent of the United States is:

1. Apparatus for setting and displaying a numerical value to be encoded to an electronic device, comprising:

a switch assembly including a plurality of pressure actuated membrane switches arranged in straight rows of at least four switches and including electrically conductive means for connecting said switches to said electronic device;

a plurality of switch actuator shafts, the number of said shafts being equal to the number of said rows, said shafts having longitudinal axes disposed in a common plane and extending respectively parallel and adjacent to said rows, each shaft including a plurality of raised annular protrusions corresponding respectively to the at least four switches of the adjacent row, each shaft protrusion being disposed adjacent one of said switches such that the shaft protrusion opens and closes the switch as the shaft is rotated about its axis, the protrusions of each shaft being formed so as to provide ten different combinations of open and closed switches in the adjacent row at corresponding positions of the shaft as the shaft is rotated about its axis, said ten combinations constituting multi-bit codes corresponding to the numbers 0–9, respectively;

support means for rotatably supporting said actuator shafts such that each shaft is manually rotatable by an operator about its axis; and numerical value display means for displaying the numerical value to be encoded to the electronic device, comprising a plurality of shaft setting display means associated respectively with said actuator shafts, each shaft setting display means displaying one of the ten numbers 0–9 corresponding to the multi-bit code produced by its associated shaft in the adjacent row of membrane switches, said numbers displayed by the plurality of shaft setting display means being oriented so that they are readable by the operator as a discrete number in standard decimal format constituting the numerical value to be encoded to the electronic device.

2. Apparatus, as described in claim 1, wherein each shaft setting display means comprises:

a series of ten numbers 0–9 disposed on a peripheral surface of the shaft associated with the shaft setting display means so that said numbers are rotated along a common path when the shaft is rotated about its axis; and an indicating means disposed adjacent the path of rotation of the series of numbers 0–9 carried by the associated actuator shaft, the numbers being disposed about the shaft so that the multi-bit code produced by the shaft in the adjacent row of membrane switches corresponds to the number adjacent the indicating means.

3. Apparatus, as described in claim 2, wherein each indicating means comprises an opening defined by said support means, through which opening only the adjacent one of the numbers 0–9 of the associated actuator shaft is visible to the operator.

4. Apparatus, as described in claim 2, wherein each indicating means comprises an indication mark carried by said support means.

5. Apparatus, as described in claim 1, wherein each shaft setting display means comprises:

an opening, defined by a surface of said support means, through which opening the actuator shaft associated with said shaft setting display means extends, said support means surface extending symmetrically about the axis of the associated actuator shaft and carrying a series of ten numbers 0–9 visible to the operator disposed about the shaft axis; and an indicator mark carried by said associated actuator shaft and disposed adjacent said support means surface, said indicator mark and said series of numbers being disposed such that the multi-bit code produced by the associated actuator shaft in the adjacent row of membrane switches corresponds to the number on the support means surface adjacent the indicator mark of the associated actuator shaft.

6. Apparatus, as described in claim 1, wherein said ten combinations of open and closed switches in each row of membrane switches constitute 4-bit binary codes corresponding to the numbers 0–9, respectively.

7. Apparatus, as described in claim 1, wherein said switch assembly is formed as a printed circuit board assembly.

8. Apparatus, as described in claim 1, wherein said actuator shafts and said support means are formed of molded plastic material.

9. Manually-actuated apparatus, which can be mounted in a housing such that only a front side of the apparatus is visible and accessible to an operator, for setting and displaying a numerical value to be encoded to an electronic device, said apparatus comprising:

a switch assembly including a plurality of pressure-actuated membrane switches arranged in straight rows of at least four switches and including electrically conductive means for connecting said switches to said electronic device;

a plurality of switch actuator shafts, the number of said shafts being equal to the number of said rows, said shafts having longitudinal axes disposed in a common plane and extending respectively parallel and adjacent to said rows, each shaft including a plurality of raised annular protrusions corresponding respectively to the at least four switches of the adjacent row, each shaft protrusion being disposed adjacent one of said switches such that the shaft protrusion opens and closes the switch as the shaft is rotated about its axis, the protrusions of each shaft being formed so as to provide ten different combinations of open and closed switches in the adjacent row at corresponding positions of the shaft as the shaft is rotated about its axis, said ten combinations constituting multi-bit codes corresponding to the numbers 0–9, respectively;

a support structure, to which said switch assembly is affixed, for rotatably supporting said actuator shafts such that each shaft is manually rotatable about its axis, said support structure including a front portion having shaft openings through which the actuator shafts respectively extend so that the front end of each actuator shaft is accessible to the operator; and display means for displaying the numerical value to be encoded to the electronic device, comprising a plurality of flanges respectively affixed to said actuator shafts, each flange having a front annular surface adjacent the support structure front portion, each flange front surface carrying a series of ten numbers 0–9 disposed about the shaft axis so that said numbers are rotated along a common path when the shaft is rotated about its axis; and a plurality of indicating means associated respectively with said actuator shafts, each indicating means being disposed adjacent the path of rotation of the series of numbers 0–9 carried by its associated actuator shaft, the numbers being disposed about the shaft axis so that the multi-bit code produced by the shaft in the adjacent row of membrane switches corresponds to the number adjacent the associated indicating means, the series of numbers 0–9 carried by the actuator shafts being oriented such that the numbers adjacent the plurality of indicating means are readable by the operator as a discreet number in standard decimal format constituting the numerical value to be encoded.

10. Apparatus, as described in claim 9, wherein:

the flange front surface of each actuator shaft is disposed adjacent an inner surface of the support structure front portion; and each indicating means comprises at opening of said support structure front portion, through which opening the adjacent one of the numbers 0–9 of the associated actuator shaft is visible to the operator.

11. Apparatus, as described in claim 9, wherein:

the flange front surface of each actuator shaft is disposed adjacent an outer surface of the support structure front portion; and each indicating means comprises an indicator mark on the outer surface of the support structure front portion.

12. Apparatus, as described in claim 9, wherein said ten combinations of open and closed switches in each row of membrane switches constitute 4-bit binary codes corresponding to the numbers 0–9 respectively.

13. Apparatus, as described in claim 9, wherein said switch assembly is formed as a printed circuit board assembly.

14. Apparatus, as described in claim 9, wherein said actuator shafts and said support structure are formed of molded plastic material.

15. A manually-actuated coding apparatus, which is mounted in a housing of an electronic artillery fuze such that only a front side of the coding apparatus is visible to an operator, for setting and displaying a numerical timing value to be encoded to the fuze, said apparatus comprising:

a switch assembly including a plurality of pressure-actuated membrane switches arranged in straight rows of at least four switches and electrically conductive means for connecting said switches to said fuze;

a plurality of switch actuator shafts, the number of said shafts being equal to the number of said rows, said shafts having longitudinal axes disposed in a common plane and extending respectively parallel and adjacent to said rows, each shaft including a plurality of raised annular protrusions corresponding respectively to the at least four switches of the adjacent row, each shaft protrusion being disposed adjacent one of said switches such that the shaft protrusion opens and closes the switch as the shaft is rotated about its axis, the protrusions of each shaft being formed so as to provide ten different combinations of open and closed switches in the adjacent row at corresponding positions of the shaft as the shaft is rotated about its axis, said ten combinations constituting multi-bit codes corresponding to the numbers 0–9, respectively;

a support structure, to which said switch assembly is affixed, for rotatably supporting said actuator shafts such that each shaft is manually rotatable about its axis, said support structure including a front portion disposed within an opening of the fuze housing, said support structure front portion having an outer surface which conforms generally to an outer surface of the fuze housing so that the edges of the outer surface of the support structure front portion are approximately flush with the adjacent outer surface of the fuze housing, said support structure front portion having shaft openings through which the actuator shafts respectively extend so that a front end surface of each actuator shaft is approximately flush with the adjacent outer surface of the support structure front portion, the front end of each actuator shaft being arranged to facilitate manual rotation of the shaft by the operator; and timing value display means for displaying a timing value to be encoded to the fuze, comprising a plurality of shaft setting display means, associated respectively with said actuator shafts, each shaft setting display means displaying one of the ten numbers 0–9 corresponding to the multi-bit code produced by its associated shaft in the adjacent row of membrane switches, said numbers displayed by the plurality of shaft setting display means being oriented and aligned so that they are readable by the operator as a discreet number in standard decimal format constituting the timing value to be encoded to the fuze.

16. Apparatus, as described in claim 15, wherein the front end surface of each actuator shaft defines a non-circular depression therein for receiving and non-rotatably engaging an operating end of a hand tool, whereby the operator can rotate the actuator shaft by inserting the operating end of the hand tool into said depression and then rotating the hand tool about the axis of the actuator shaft.

17. Apparatus, as described in claim 15, wherein the outer surface of the fuze housing extends symmetrically about an axis of the fuze housing, and the axes of the actuator shafts are disposed at an angle to one another to thus better conform the front end surface of each actuator shaft with the fuze housing outer surface.

18. Apparatus, as described in claim 15, wherein each shaft setting display means comprises:

a flange affixed to the actuator shaft associated with said shaft setting display means, said flange having a front annular surface adjacent an inner surface of said support structure front portion, said flange front surface carrying a series of ten numbers 0–9 disposed about the shaft axis so that said numbers are rotated along a common path when the shaft is rotated about its axis; and an opening through said support structure front portion adjacent the path of rotation of the series of numbers 0–9 carried by the associated actuator shaft, through which opening an adjacent one of the numbers 0–9 is visible to the operator, the numbers 0–9 being disposed about the actuator shaft so that the multi-bit code produced by the shaft in the adjacent row of membrane switches corresponds to the number adjacent the opening.

19. Apparatus, as described in claim 15, wherein each shaft setting display means comprises:

a series of ten numbers 0–9 carried on the front end surface of the actuator shaft associated with said shaft setting display means, said series of ten number 0–9 being disposed about the shaft axis so that said numbers are rotated along a common path where the shaft is rotated about its axis; and an indicator mark disposed on the outer surface of the support structure front portion adjacent the path of rotation of the series of number 0–9 carried by the associated actuator shaft, said numbers being disposed about the actuator shaft so that the multi-bit code produced by the shaft in the adjacent row of membrane switches corresponds to the number adjacent the indicator mark.

20. Apparatus, as described in claim 15, wherein each shaft setting display means comprises:

an indicator mark disposed on the front end surface of the associated actuator shaft, to indicate the angular disposition of the shaft about its axis; and a series of ten numbers 0–9 disposed about the actuator shaft on the outer surface of the support structure front portion so that the multi-bit code produced by the shaft in the adjacent row of membrane switches corresponds to the number adjacent the indicator mark.

* * * * *